US011208840B1

(12) United States Patent
Morgan

(10) Patent No.: US 11,208,840 B1
(45) Date of Patent: Dec. 28, 2021

(54) SOFT ROLL-UP DOOR WITH FALL PROTECTION

(71) Applicant: Goff's Enterprises, Inc., Pewaukee, WI (US)

(72) Inventor: Brian Morgan, Oconomowoc, WI (US)

(73) Assignee: GOFF'S ENTERPRISES, INC., Pewaukee, WI (US)

( * ) Notice: Subject to any disclaimer, the term of this patent is extended or adjusted under 35 U.S.C. 154(b) by 252 days.

(21) Appl. No.: 16/674,005

(22) Filed: Nov. 5, 2019

(51) Int. Cl.
*E06B 9/15* (2006.01)
*E06B 9/58* (2006.01)
*E06B 9/40* (2006.01)

(52) U.S. Cl.
CPC ..... *E06B 9/15* (2013.01); *E06B 9/581* (2013.01); *E06B 9/40* (2013.01); *E06B 2009/1566* (2013.01)

(58) Field of Classification Search
CPC ..... E06B 9/13; E06B 2009/135; E06B 9/581; E06B 9/0692; E06B 9/063; E06B 9/02; E06B 9/15; E06B 2009/1505; E06B 2009/1566
See application file for complete search history.

(56) References Cited

U.S. PATENT DOCUMENTS 731,328 A * 6/1903 Swearinger ..... E06B 9/581 160/271
4,712,598 A * 12/1987 Bonacci ..... E06B 9/262 160/327
4,974,658 A * 12/1990 Komatsu ..... E06B 9/13 160/133
9,422,732 B2 * 8/2016 Gower ..... E04G 21/3233
2015/0368965 A1 * 12/2015 Meyere ..... E06B 9/581 160/133
2017/0009524 A1 * 1/2017 Dwarka ..... E06B 9/42
2017/0356239 A1 * 12/2017 Ouyang ..... E06B 9/581

OTHER PUBLICATIONS

Dock door size pamphlet—mhi.org collected from Google search Aug. 26, 2021—for general information (Year: 2021).*
Screen clipping from engineeringtoolbox.com—collected Aug. 27, 2021—for general information (Year: 2021).*

* cited by examiner

*Primary Examiner* — Daniel P Cahn
*Assistant Examiner* — John W Hanes, Jr.
(74) *Attorney, Agent, or Firm* — Donald J. Ersler

(57) ABSTRACT

A roll-up door with fall protection preferably includes a door web, a pair of guide tracks, a pair of lower track brackets, a plurality of upper track brackets and a door web roller. The door web includes a plurality of screen web panels and wind bars. Opposing ends of the door web are retained in the pair of guide tracks. A first wind bar is arraigned to be 42 inches off a floor to meet OSHA fall protection standards. The door web includes at least two upper wind bars above the first wind bar and at least one lower wind bar below the first wind bar. The pair of guide tracks are secured to a wall with the pair of lower track brackets and the plurality of upper track brackets. A top of the pair of lower track brackets are located at least 42 inches above the floor.

20 Claims, 8 Drawing Sheets

SOFT ROLL-UP DOOR WITH FALL PROTECTION

BACKGROUND OF THE INVENTION

1. Field of the Invention

The present invention relates generally to buildings and more specifically to a soft roll-up door with fall protection, which allows air flow through the door, while complying with OSHA standards for fall protection.

2. Discussion of the Prior Art

Presently, dock doors are left open to provide air flow to a warehouse, factory or the like through a loading dock. OSHA requires fall protection when the door is open. An OSHA fall protection system includes two rigidly mounted vertical support posts and two horizontal bars mounted between the two rigidly mounted vertical support posts. However, the OSHA fall protection system is only 42 inches high. There has been at least one case of a worker reaching over the OSHA fall protection system and falling off the dock. It appears that the prior art does not teach or suggest a soft roll-up door with fall protection, which is located behind a hard door.

Accordingly, there is a clearly felt need in the art for a soft roll-up door with fall protection, which allows air flow through the door, while complying with OSHA standards for fall protection.

SUMMARY OF THE INVENTION

The present invention provides a soft roll-up door with fall protection, which allows air flow through the door, while complying with OSHA standards for fall protection. The soft roll-up door with fall protection (soft roll-up door) preferably includes a door web, a pair of guide tracks, a pair of lower track brackets, a plurality of upper track brackets and a door web roller. Each guide track includes a substantial C-shaped cross section. The door web includes a plurality of screen web panels and a plurality of wind bars. Each screen web panel includes a screen web, a top cylinder object and a lower cylindrical object. A top of the screen web is wrapped over the top cylindrical object and attached to itself preferably with sonic welding to form a top ridge. A bottom of the screen web is wrapped over the bottom cylindrical object and attached to itself preferably with sonic welding to form a bottom ridge.

Each wind bar includes a top retention slot and a bottom retention slot. The top ridge of the screen web panel is slid into the bottom retention slot of one wind bar and the bottom ridge is slid into the top retention slot of an adjacent wind bar, below the one wind bar. A width of the plurality of wind bars is the same as a width of the plurality of screen web panels. A wind bar cap includes a cavity, which is sized to receive an outer perimeter of the wind bar, and a pair of opposing slots, which are sized to receive a thickness of the screen web. An inner perimeter of the pair of guide tracks is sized to receive an outer perimeter of the wind bar. The plurality of wind bars are preferably fabricated from a long hair fiberglass, but other materials may also be used. Opposing ends of a front of the door web are guided by a pair of guide plates attached to a front of the pair of guide tracks. Each guide plate includes a base portion and an offset portion. The offset portion extends upward from the base portion. The offset portion is offset to provide clearance for the plurality of wind bar caps.

A first wind bar is arraigned to be 42 inches off a floor, when a bottom of the door web contacts the floor to meet OSHA fall protection standards. The door web includes at least two upper wind bars above the first wind bar and at least one lower wind bar below the first wind bar. The pair of guide tracks are secured to a wall with a pair of lower track brackets and a plurality of upper track brackets. A top of the pair of lower track brackets are located at least 42 inches above the floor to meet OSHA fall protection standards. The door web roller includes a roller frame and a roll tube. Each end of the roll tube is rotatably retained in the roller frame. A top of the door web is retained on the roll tube. The roll tube may be rotated manually or with an electric motor. Opposing ends of the door web roller are preferably attached to a top of the pair of guide tracks and to the wall with a pair of roller brackets. The combination of the pair of lower track brackets, the pair of track rails and the door web is strong enough withstand a force of at least 200 pounds applied in a horizontal axis from a front or sides.

Accordingly, it is an object of the present invention to provide a roll-up door, which allows air flow through the door, while complying with OSHA standards for fall protection.

These and additional objects, advantages, features and benefits of the present invention will become apparent from the following specification.

DETAILED DESCRIPTION OF THE PREFERRED EMBODIMENTS

Figure 1:
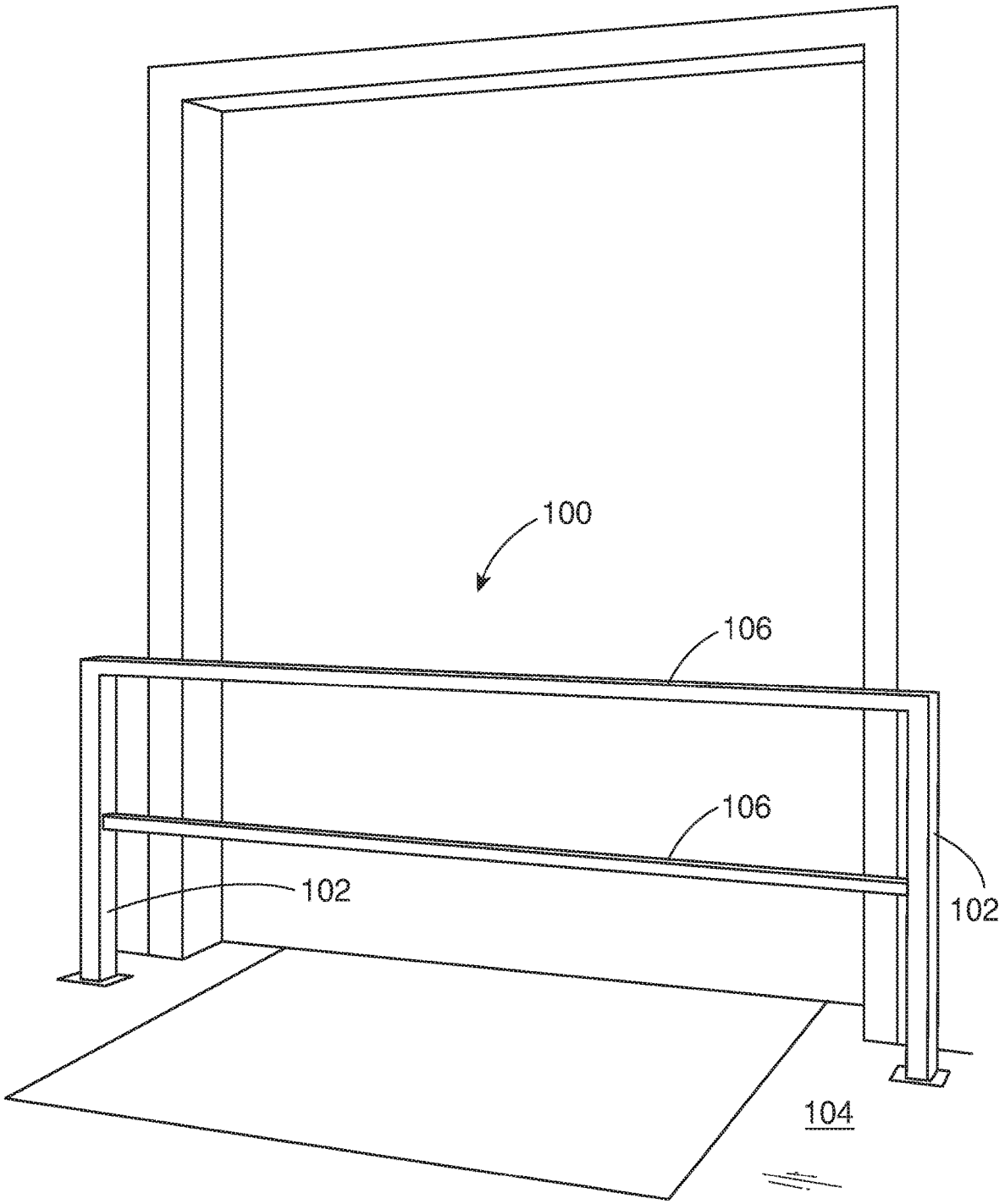
FIG. 1 (Prior Art)
FIG. 1 is a perspective view of a prior art OSHA approved fall protection system.
Figure 2:
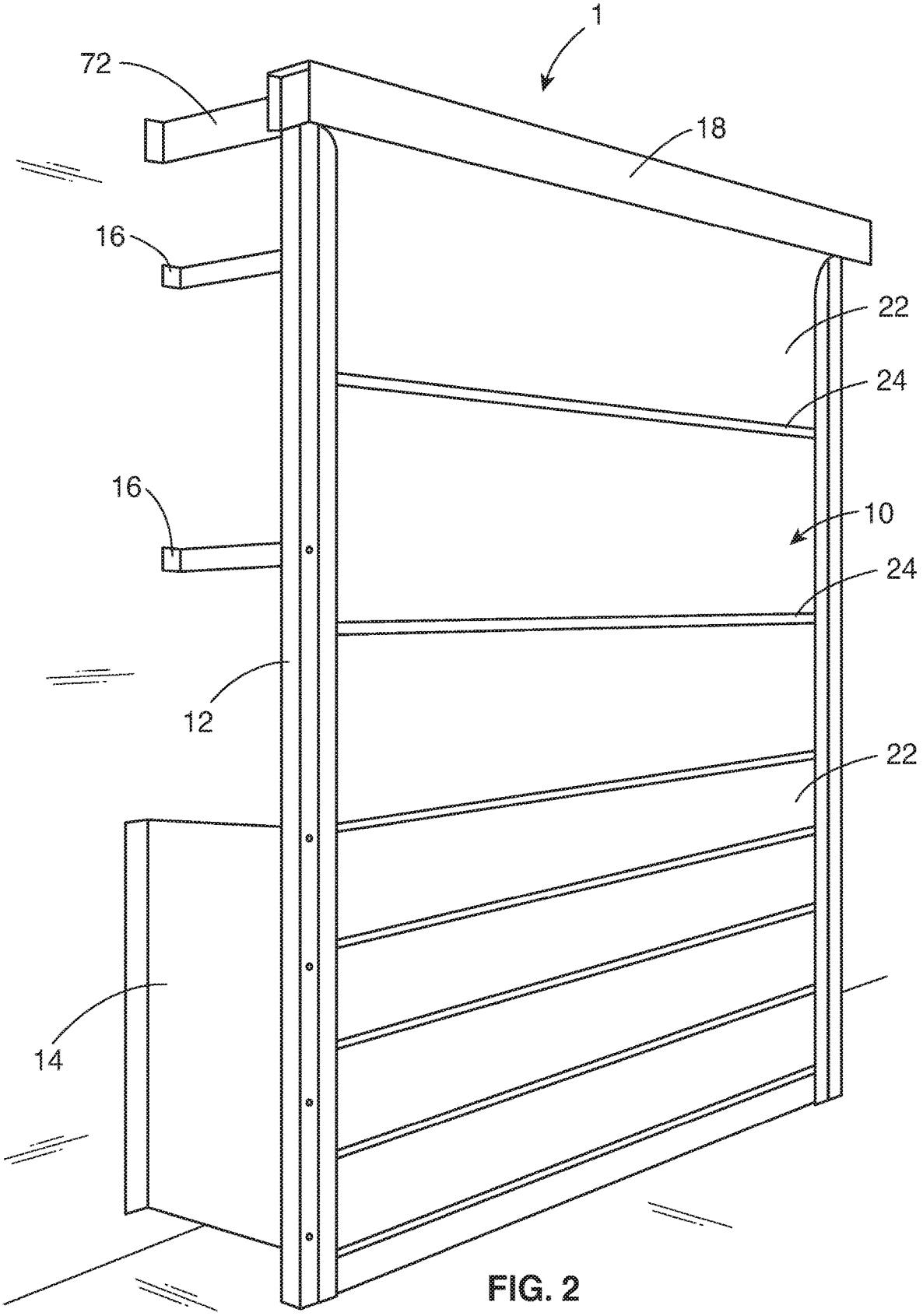
FIG. 2 is a perspective view of a soft roll-up door in accordance with the present invention.
Figure 3:
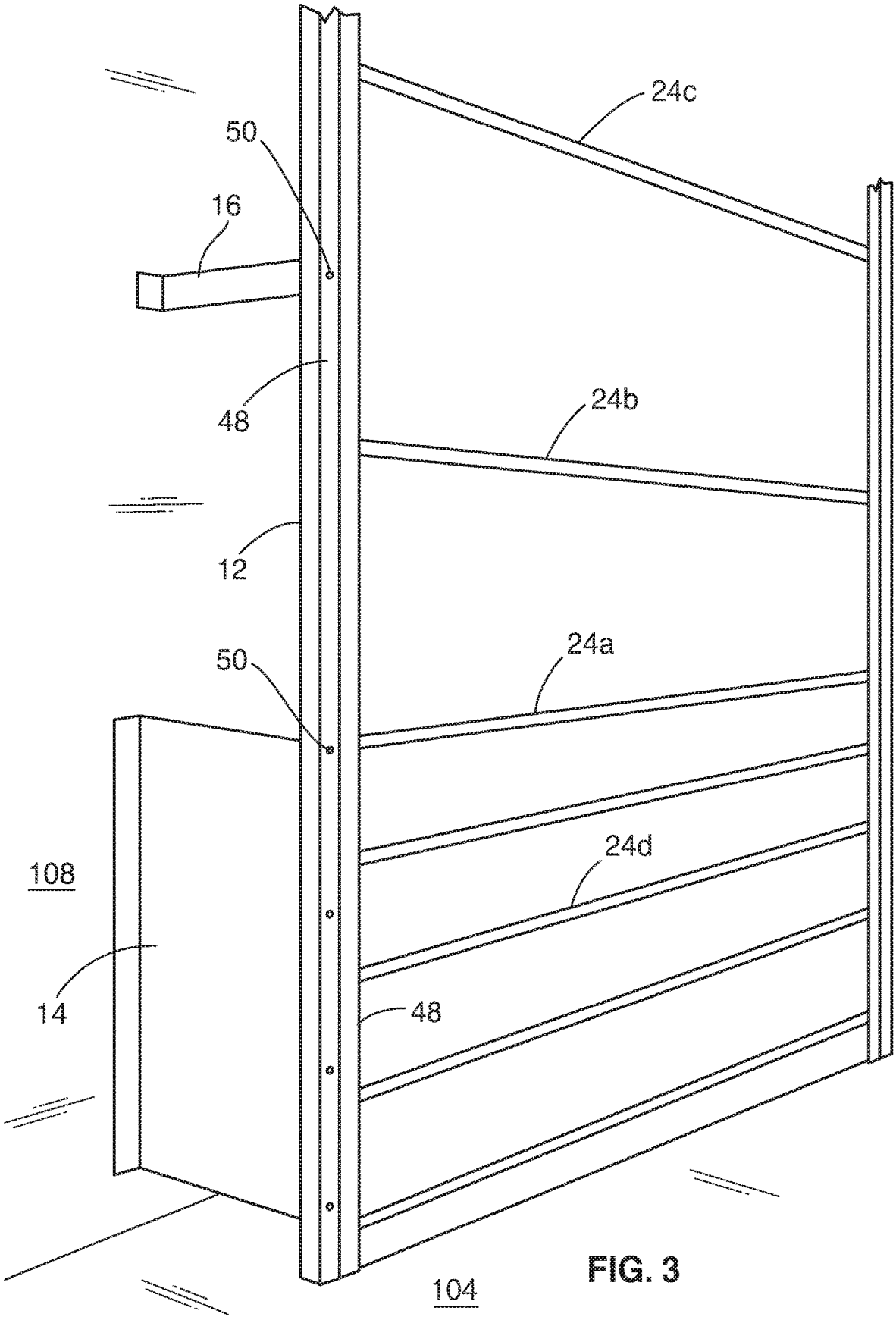
FIG. 3 is a partial bottom perspective view of a soft roll-up door in accordance with the present invention.
Figure 9:
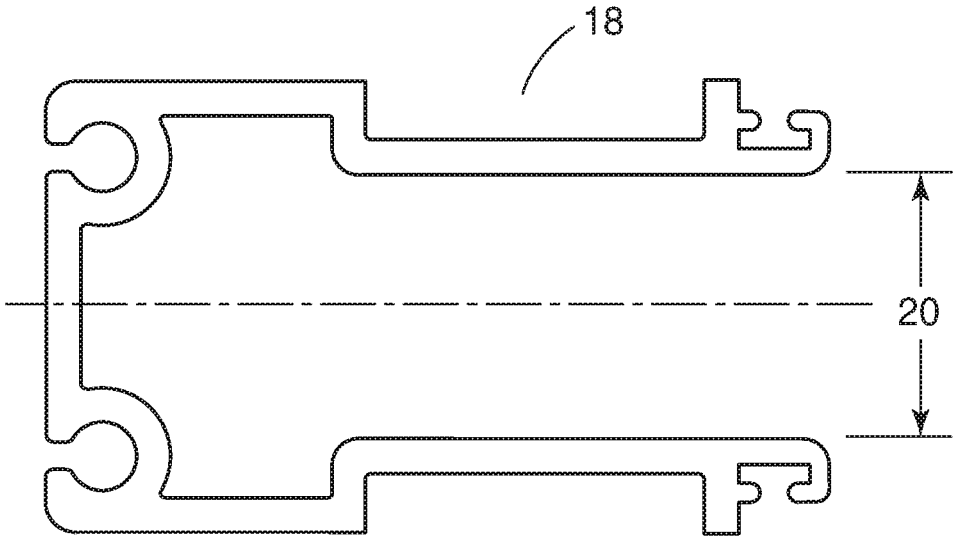
FIG. 9 is a top view of a guide track of a soft roll-up door in accordance with the present invention.

With reference now to the drawings, and particularly to FIG. 1, there is shown a perspective view of a prior art OSHA fall protection system 100. The OSHA fall protection system 100 includes two vertical support posts 102 rigidly mounted to a floor 104 and two horizontal bars 106 mounted between the two vertical support posts 102. The top horizontal bar 106 has a height of 42 inches relative to the floor 104. With reference to FIG. 2, a soft roll-up door 1 preferably includes a door web 10, a pair of guide tracks 12, a pair of lower track brackets 14, a plurality of upper track brackets 16 and a door web roller 18. With reference to FIG. 9, each guide track 18 includes a substantial C-shaped cross section. The guide track 18 includes an inner dimension 20.

Figure 5:
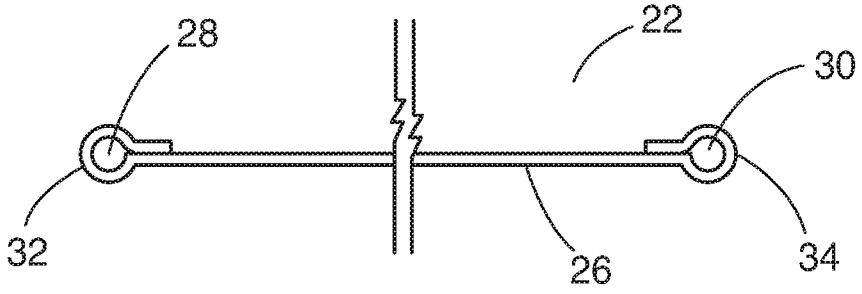
FIG. 5 is an end view of a web screen panel of a soft roll-up door in accordance with the present invention.
Figure 6:
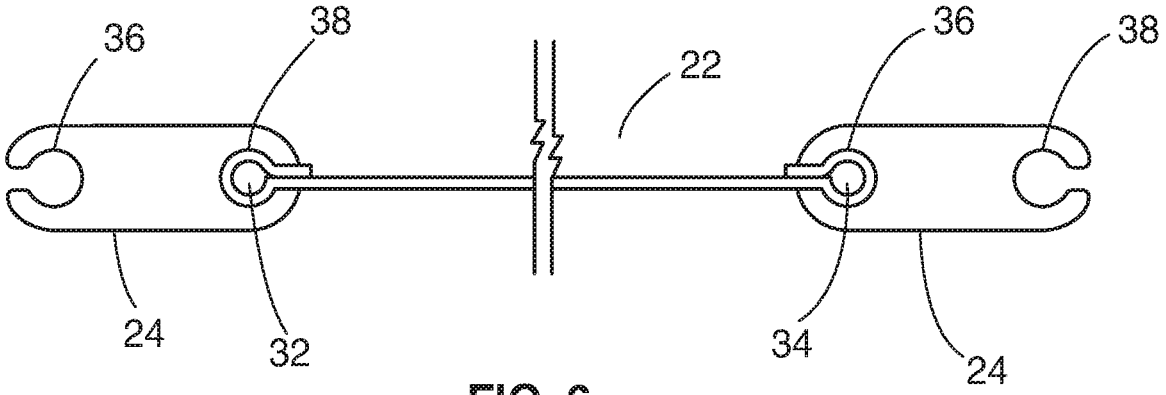
FIG. 6 is an end view of a web screen panel of a soft roll-up door retained by two wind bars in accordance with the present invention.

With reference to FIGS. 5-6, the door web 10 includes a plurality of screen web panels 22 and a plurality of wind bars 24. Each screen web panel 22 includes a screen web 26, a top cylinder object 28 and a lower cylindrical object 30. The screen web 26 is fabricated from a plurality of fibers woven together to allow the flow of air therethrough. A top of the screen web 26 is wrapped over the top cylindrical object 28 and attached to itself preferably with sonic welding to form a top ridge 32. A bottom of the screen web 26 is wrapped over the bottom cylindrical object 30 and attached to itself preferably with sonic welding to form a bottom ridge 34. Each wind bar 24 includes a top retention slot 36 and a bottom retention slot 38. The top ridge 32 of the screen web panel 22 is slid into the bottom retention slot 38 of one wind bar 24 and the bottom ridge 34 is slid into the top retention slot 36 of an adjacent wind bar 24. A width of the plurality of wind bars 24 is the same as a width of the plurality of screen web panels 22.

Figure 7:
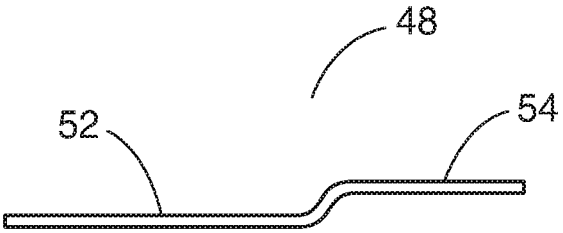
FIG. 7 is a bottom view of a guide plate of a soft roll-up door in accordance with the present invention.
Figure 8:
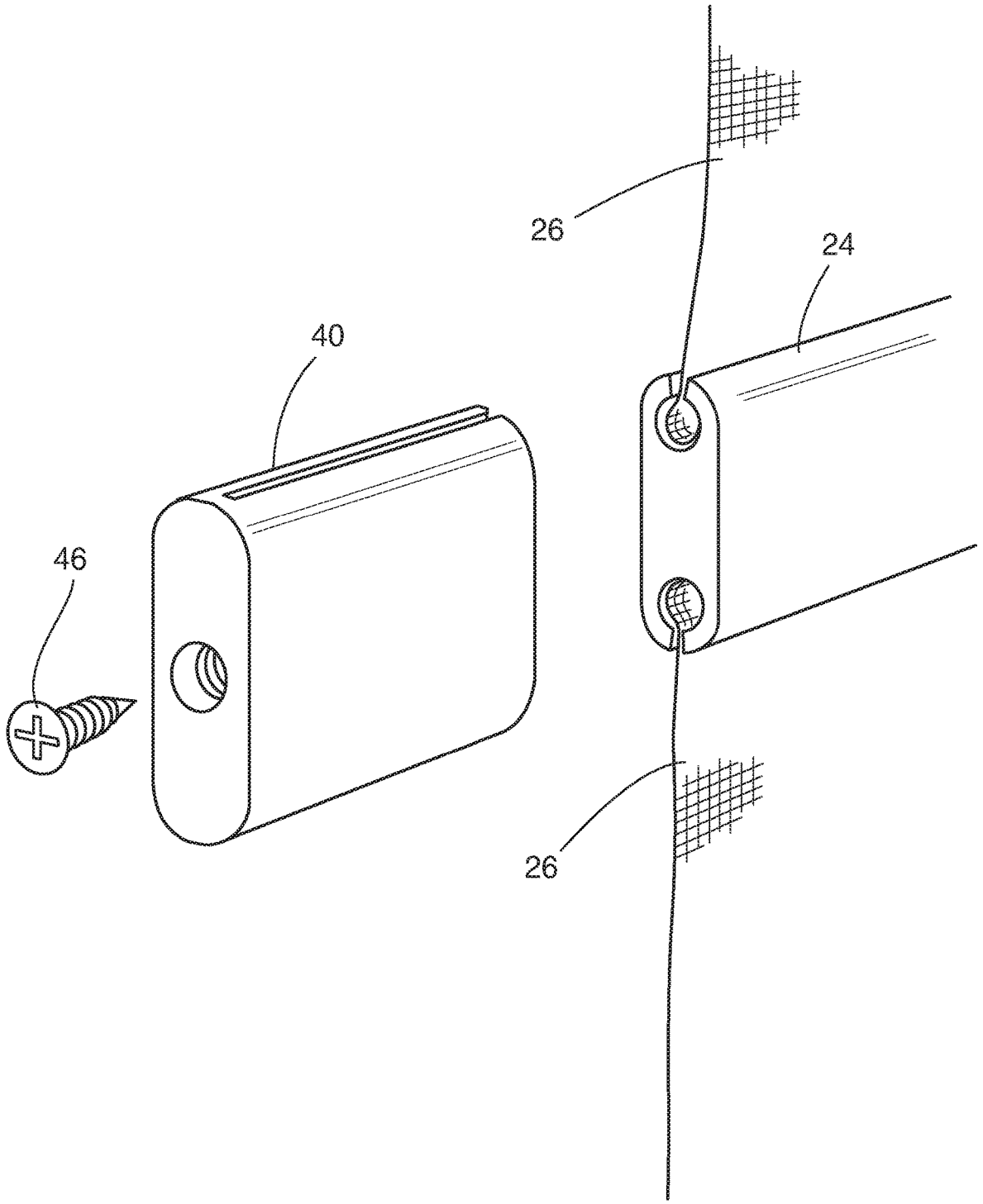
FIG. 8 is a perspective view of a wind bar cap, which is sized to receive an outer perimeter of a wind bar and two web screen panels of a soft roll-up door in accordance with the present invention.
Figure 10:
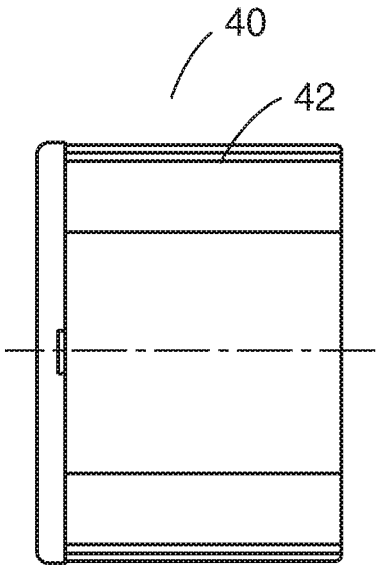
FIG. 10 is a cross sectional view of a wind bar cap of a soft roll-up door in accordance with the present invention.
Figure 11:
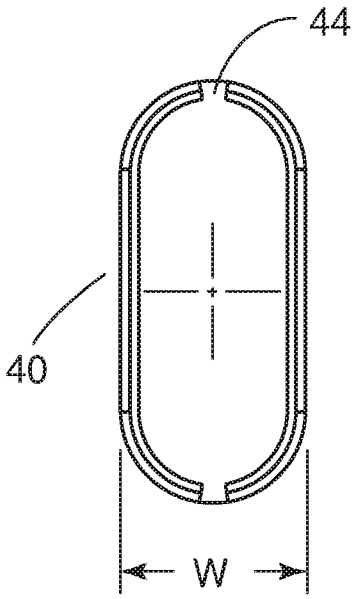
FIG. 11 is a cross sectional view of a wind bar cap of a soft roll-up door in accordance with the present invention.
Figure 12:
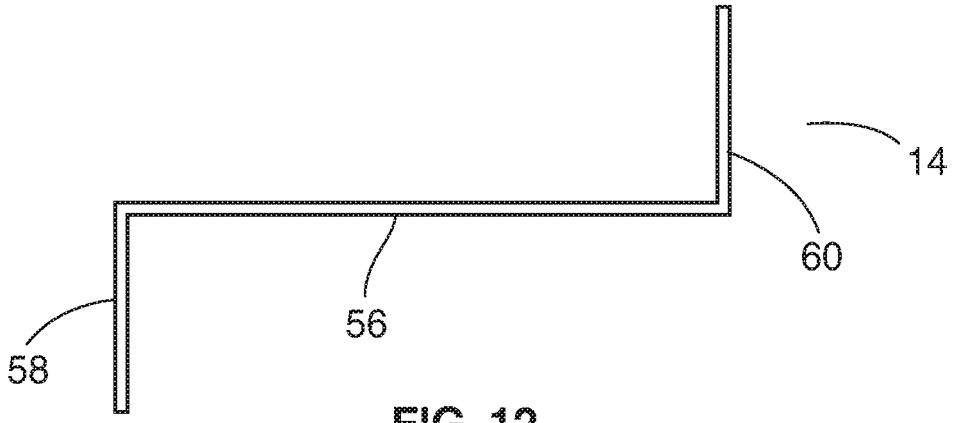
FIG. 12 is a top view of a lower track bracket of a soft roll-up door in accordance with the present invention.
Figure 13:
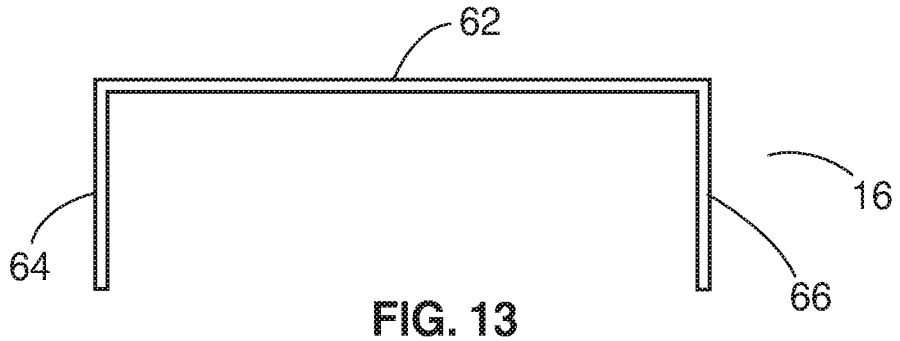
FIG. 13 is a top view of an upper track bracket of a soft roll-up door in accordance with the present invention.
Figure 14:
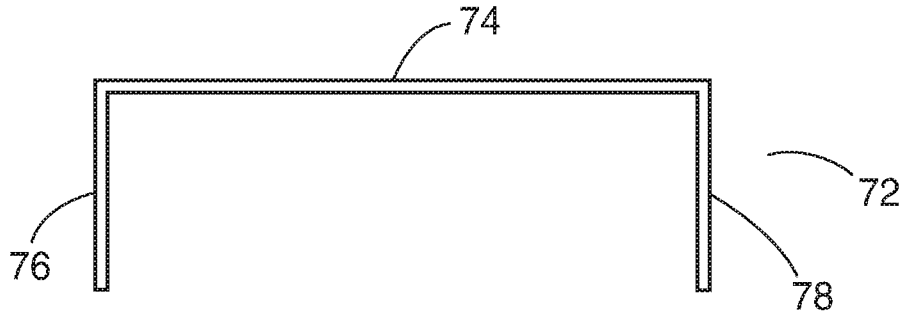
FIG. 14 is a top view of a roller bracket of a soft roll-up door in accordance with the present invention.

With reference to FIGS. 8, 10 and 11, a wind bar cap 40 includes a cavity 42, which is sized to receive an outer perimeter of the wind bar 24, and a pair of opposing slots 44, which are sized to receive a thickness of the screen web 26. An inner dimension 20 of the pair of guide tracks 18 is sized to receive a width "W" of the wind bar cap 40. A screw 46 is used to retain the wind bar cap 40 on the end of the wind bar 24. The wind bar cap 40 prevents the screen web panel 22 from sliding relative to the wind bar 24. The plurality of wind bars 24 are preferably fabricated from a long hair fiberglass, but other materials may also be used. Opposing ends of a front of the door web 10 are guided by a pair of guide plates 48 attached to a front of the pair of guide tracks with fasteners 50. With reference to FIG. 7, each guide plate 48 includes a base portion 52 and an offset portion 54. The offset portion 54 extends upward from the base portion 52. The offset portion 54 is offset to provide clearance for the plurality of wind bar caps 40.

Figure 4:
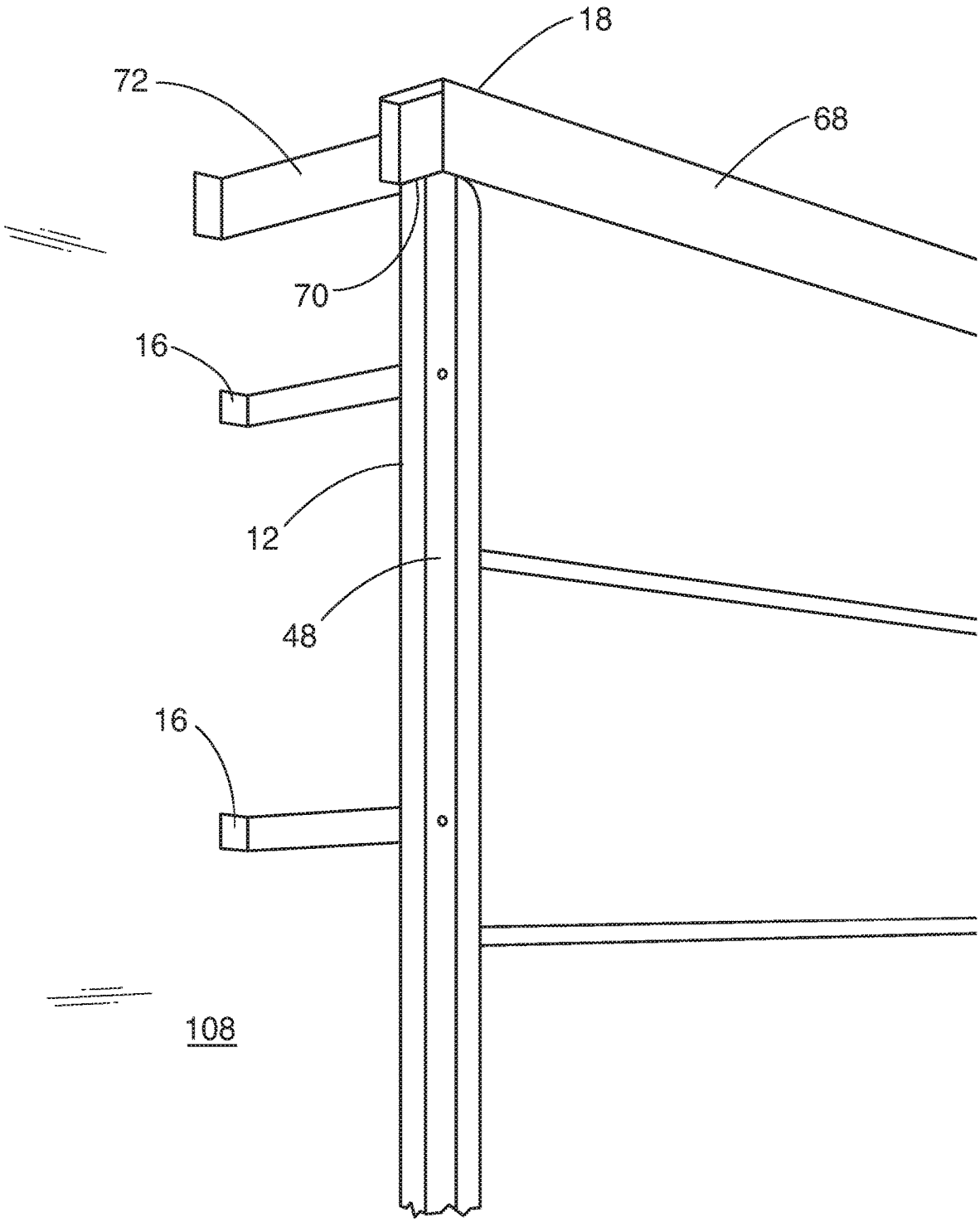
FIG. 4 is a partial top perspective view of a soft roll-up door in accordance with the present invention.

A first wind bar 24*a* is arraigned to be 42 inches off the floor 104, when a bottom of the door web 10 contacts the floor 104 to meet OSHA fall protection standards. The door web 10 includes at least two upper wind bars 24*b*, 24*c* located above the first wind bar 24*a* and at least one lower wind bar 24*d* below the first wind bar 24*a*. Alternatively, a spacing between the plurality of wind bars 24 located below the wind bar 24*a* is less than the spacing between the plurality of wind bars 24 located above the wind bar 24*a*. The pair of guide tracks 12 are secured to a wall 108 with a pair of lower track brackets 14 and a plurality of upper track brackets 16. Each lower track bracket 14 includes a base member 56, a wall flange 58 and a guide flange 60. Each upper track bracket 16 includes a base member 62, a wall flange 64 and a guide flange 66. A top of the pair of lower track brackets 16 are located at least 42 inches above the floor 104 to meet OSHA fall protection standards. With reference to FIG. 4, the door web roller 18 includes a roller frame 68 and a roll tube 70. Each end of the roll tube 68 is rotatably retained in the roller frame 68. A top of the door web 10 is retained on the roll tube 70. The roll tube 70 may be rotated manually or with an electric motor. Opposing ends of the door web roller 68 are preferably attached to a top of the pair of guide tracks 12 and to the wall 108 with a pair of roller brackets 72. Each roller bracket 72 includes a base member 74, a wall flange 76 and a roller flange 78. The combination of the pair of lower track brackets 14; the pair of guide tracks 12; the door web 10; and the wind bars 24*a* and 24*d* in the door web 10 is strong enough withstand a force of 200 pounds applied in a horizontal axis from a front or sides.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A soft roll-up door with fall protection comprising:

a door web includes a plurality of screen web panels and a plurality of wind bars, a spacing between said plurality of wind bars below 42 inches from a floor is less than a spacing of said plurality of wind bars above 42 inches;

a pair of guide tracks each include a substantially C-shaped cross section for retaining opposing ends of said door web, wherein said pair of guide tracks are capable of being secured to a wall;

and a door web roller is retained at a top of said pair of guide tracks to retain an end of said door web.

2. The soft roll-up door with fall protection of claim 1, further comprising:

at least one pair of upper track brackets having one end attached to said pair of guide tracks, an opposing end of said pair of upper track brackets capable of being attached to the wall.

3. The soft roll-up door with fall protection of claim 1 wherein:

each screen web panel includes a screen web, a top cylinder object and a lower cylindrical object, a top of the screen web is wrapped over said top cylindrical object and attached to itself to form a top ridge, a bottom of said screen web is wrapped over said bottom cylindrical object and attached to itself to form a bottom ridge.

4. The soft roll-up door with fall protection of claim 3 wherein:

said plurality of wind bars include a top retention slot and a bottom retention slot, said top ridge of said screen web panel is slid into said bottom retention slot of one of said plurality of wind bars, said bottom ridge is slid into said top retention slot of another one of said plurality of wind bars.

5. The soft roll-up door with fall protection of claim 4, further comprising:

a wind bar cap includes a cavity which is sized to receive an outer perimeter of one of said plurality of wind bars and a pair of opposing slots which are sized to receive a thickness of said screen web, an inner dimension of said pair of guide tracks is sized to receive a width of said wind bar cap.

6. The soft roll-up door with fall protection of claim 1, further comprising:

said door web roller is retained at a top of said pair of guide tracks with a pair of roller brackets.

7. The soft roll-up door with fall protection of claim 1, further comprising:

a pair of lower track brackets having one end attached to said pair of guide tracks, an opposing end of said pair of lower track brackets is capable of being attached to a wall.

8. A soft roll-up door with fall protection comprising:

a door web includes a plurality of screen web panels and a plurality of wind bars, a spacing between said plurality of wind bars below 42 inches from the floor is less than a spacing of said plurality of wind bars above 42 inches;

a pair of guide tracks each include a substantially C-shaped cross section for retaining opposing ends of said door web, wherein said pair of guide tracks are capable of being secured to a wall, a pair of lower track brackets, said door web and said pair of guide tracks at 42 inches and below from a floor are strong enough to withstand a force of 200 pounds applied in a horizontal axis to a front of said soft roll-up door;

and a door web roller is retained at a top of said guide tracks to retain an end of said door web.

9. The soft roll-up door with fall protection of claim 8, further comprising:

at least one pair of upper track brackets having one end attached to said pair of guide tracks, an opposing end of said pair of upper track brackets capable of being attached to the wall.

10. The soft roll-up door with fall protection of claim 8 wherein:

each screen web panel includes a screen web, a top cylinder object and a lower cylindrical object, a top of the screen web is wrapped over said top cylindrical object and attached to itself to form a top ridge, a bottom of said screen web is wrapped over said bottom cylindrical object and attached to itself to form a bottom ridge.

11. The soft roll-up door with fall protection of claim 10 wherein:

said plurality of wind bars include a top retention slot and a bottom retention slot, said top ridge of said screen web panel is slid into said bottom retention slot of one of said plurality of wind bars, said bottom ridge is slid into said top retention slot of another one of said plurality of wind bars.

12. The soft roll-up door with fall protection of claim 11, further comprising:

a wind bar cap includes a cavity which is sized to receive an outer perimeter of one of said plurality of wind bars and a pair of opposing slots which are sized to receive a thickness of said screen web, an inner dimension of said pair of guide tracks is sized to receive a width of said wind bar cap.

13. The soft roll-up door with fall protection of claim 8, further comprising:

said door web roller is retained at a top of said pair of guide tracks with a pair of roller brackets.

14. The soft roll-up door with fall protection of claim 8, further comprising:

the pair of lower track brackets having one end attached to said pair of guide tracks, an opposing end of said pair of lower track brackets is capable of being attached to a wall.

15. A soft roll-up door with fall protection comprising:

a door web includes a plurality of screen web panels and a plurality of wind bars, one of said plurality of wind bars has a height of 42 inches relative to a floor, a spacing between said plurality of wind bars below said 42 inch wind bar is less than a spacing of said plurality of wind bars above said 42 inch wind bar;

a pair of guide tracks each include a substantially C-shaped cross section for retaining opposing ends of said door web, said pair of guide tracks are capable of being attached to a vertical surface, a pair of lower track brackets, said pair of guide tracks and said door web that are at 42 inches and below from the floor are strong enough to withstand a force of 200 pounds applied in a horizontal axis to a front of said soft roll-up door;

and a door web roller is retained at a top of said guide tracks to retain an end of said door web.

16. The soft roll-up door with fall protection of claim 15, further comprising:

the pair of lower track brackets having one end attached to said pair of guide tracks, an opposing end of said pair of lower track brackets is capable of being attached to a wall; and at least one pair of upper track brackets having one end attached to said pair of guide tracks, an opposing end of said pair of upper track brackets capable of being attached to the wall.

17. The soft roll-up door with fall protection of claim 15 wherein:

each screen web panel includes a screen web, a top cylinder object and a lower cylindrical object, a top of the screen web is wrapped over said top cylindrical object and attached to itself to form a top ridge, a bottom of said screen web is wrapped over said bottom cylindrical object and attached to itself to form a bottom ridge.

18. The soft roll-up door with fall protection of claim 17 wherein:

said plurality of wind bars include a top retention slot and a bottom retention slot, said top ridge of said screen web panel is slid into said bottom retention slot of one of said plurality of wind bars, said bottom ridge is slid into said top retention slot of another one of said plurality of wind bars.

19. The soft roll-up door with fall protection of claim 18, further comprising:

a wind bar cap includes a cavity which is sized to receive an outer perimeter of one of said plurality of wind bars and a pair of opposing slots which are sized to receive a thickness of said screen web, an inner dimension of said pair of guide tracks is sized to receive a width of said wind bar cap.

20. The soft roll-up door with fall protection of claim 15, further comprising:

said door web roller is retained at a top of said pair of guide tracks with a pair of roller brackets.

* * * * *